United States Patent [19]

Hazlett

[11] 4,176,040

[45] Nov. 27, 1979

[54] COAL LIQUEFACTION

[75] Inventor: Robert N. Hazlett, Alexandria, Va.

[73] Assignee: The United States of America as represented by the Secretary of the Navy, Washington, D.C.

[21] Appl. No.: 903,464

[22] Filed: May 8, 1978

[51] Int. Cl.[2] ..... C10G 1/00; C10B 57/12

[52] U.S. Cl. ..... 208/8 LE; 201/36

[58] Field of Search ..... 208/8 LE; 201/36

[56] References Cited

U.S. PATENT DOCUMENTS

| | | | |
|---|---|---|---|
| 2,054,725 | 9/1936 | Jason | 208/8 LE |
| 2,242,822 | 5/1941 | Fuchs | 208/8 LE |
| 3,047,472 | 7/1962 | Gorin et al. | 201/36 X |
| 3,632,479 | 1/1972 | Lee et al. | 201/36 X |
| 4,108,731 | 8/1978 | Palumbo et al. | 201/36 X |

*Primary Examiner*—Delbert E. Gantz
*Assistant Examiner*—William G. Wright
*Attorney, Agent, or Firm*—R. S. Sciascia; Philip Schneider; Thomas McDonnell

[57] ABSTRACT

A method for converting coal to liquid hydrocarbons or oil-soluble solids comprises the steps of contacting said coal with oxygen for at least 15 minutes, at a temperature from about 90° to about 225° C., heating the oxidized coal to a temperature from about 250° to about 450° C., and maintaining the temperature for at least 15 minutes.

15 Claims, 1 Drawing Figure

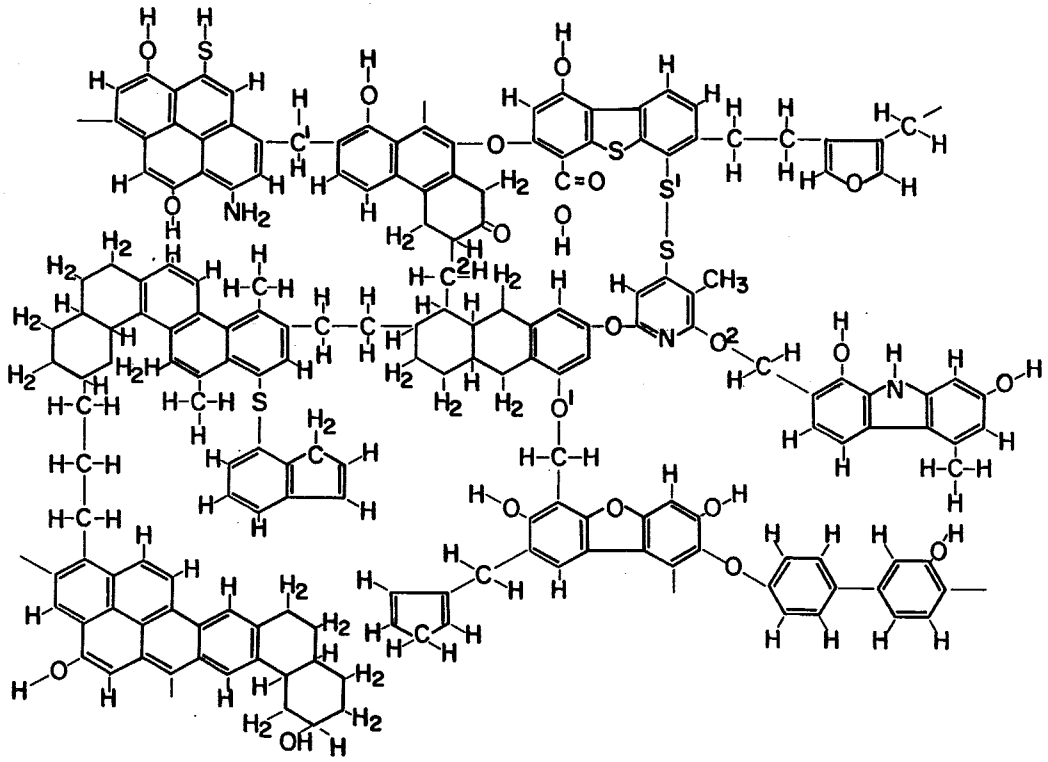

COAL LIQUEFACTION

BACKGROUND OF THE INVENTION

The invention pertains generally to coal liquefaction and particularly to coal liquefaction by oxidation and heating.

Chemically, coal is a compacted mixture of organic compounds containing carbon, hydrogen, nitrogen, sulfur and oxygen. A very high proportion of the compounds comprises large aromatic molecules, i.e., molecules having a molecular weight of at least 1000.

In order to obtain usable liquid hydrocarbons or oil-soluble solids, the large molecules must be broken into molecules with a molecular weight of no more than 400. Saturation of the molecule also increases the liquefaction of the coal. A widely used technique for cracking coal molecules is pyrolysis which proceeds by breaking C—C bonds with thermal energy. The disadvantages of this method are the requirement of a coal particle size from 75 to 150 microns, an absence of oxygen during the process, high temperatures and long heating times, and low yields. A more successful technique is hydrogenation which proceeds by saturating unsaturated bonds and hydrogenating C—C bonds broken by catalysis, heat, and pressure. The disadvantages of this method are that it requires moderately high temperatures, high hydrogen pressures, a small particle size from 75 to 150 microns, and expensive processing equipment. The yield is much better than yields from pyrolytic methods. The amount of usable products can be as high as 50 to 55 percent of the original weight of coal.

SUMMARY OF THE INVENTION

It is therefore an object of this invention to obtain liquid hydrocarbons and oil-soluble solids from coal by a method requiring significantly milder processing conditions, shorter processing times, and an inexpensive reactant.

A further object of the invention is to provide a coal-liquefaction method utilizing simple and inexpensive equipment.

Another object of this invention is to obtain liquid hydrocarbons and oil-soluble solids from coal in good yields.

These and other objects are achieved by oxidizing C—H bonds adjacent to aromatic and heteroaromatic rings or S—C bonds and O—C bonds inside and outside of such rings and then thermally stressing the oxidized coal molecules.

BRIEF DESCRIPTION OF THE DRAWING

The FIGURE is a molecular formula illustrating the typical organic moieties found in coal.

DETAILED DESCRIPTION OF THE INVENTION

A better understanding of the present invention is obtained by reference to the FIGURE, which is taken from Wolk et al *Desulfurization and Denitrogenation in Coal Liquefaction.* In A.C.S. Div. of Fuel Chem. Preprints 20(2): p.116. Apr. 6-11, 1975. It has been determined that the C—H bonds adjacent to aromatic ring e.g. $C^1$ and $C^2$, and to a lesser extent, the C—S and C—O bonds e.g. $S^1$, $O^1$ or $O^2$, of a coal molecule can be oxidized with air without oxidizing the rest of the coal molecule. Further, the oxidation of the C—H bonds weakens the C—C bonds, thus allowing the molecule to break apart upon moderate heating. The particularly noteworthy concepts of this process are the preferential oxidation of the C—H, C—C and C—O bonds, the effectiveness of air, the significant reduction in the severity of processing conditions, and the option of using an inert carrier liquid.

These particular bonds and the structure similar to that shown in the above formula are found in most coals. Consequently, many types of coal can be processed. However, on account of the high carbon content of anthracite coal, the process of the present invention is not particularly suited for this coal. The scarcity of this coal also makes the process less useful with anthracite than with other types of coal. Bituminous, lignite and processed coal, e.g., solvent refined, are particularly suited for this process. Any source of oxygen including air can be utilized. The use of air is a major advantage of this invention and consequently it is the preferred source of oxygen. It should be noted that the processing practicalities require an oxygen-containing fluid to have at least 5 volume percent of oxygen. The oxidation step proceeds quickly enough that a catalyst is not required. Of course, a catalyst can still be added to increase the speed of the oxidation step, to effect the product composition, or to increase the yield, but generally the amount of improvement would not justify the added cost.

Basically, the oxidation of the C—H, C—S, and C—O bonds is achieved by thoroughly contacting coal with oxygen. The contacting may be achieved, for example, by passing an oxygen-containing fluid through a liquid mixture, slurry, or solution of coal, by spraying a liquid mixture or solution of coal into an oxygen containing atmosphere, by fluidizing dry coal particles with an oxygen containing fluid, or by using a two-phase reactor. The processing can either batch or continuous. If the processing is continuous, single or multiple-pass equipment can be used.

If wet processing is selected, the carrier liquid must be nonreactive with nitrogen, oxygen and coal. A solution is preferred over a suspension. Consequently, quinoline, pyridine, and benzene are preferred in that coal is partially soluble in all three. Generally, aromatic or heteroaromatic compounds which are liquids from 80° to 250° C. with outside chains and without any oxygen or sulfur in the ring structure are useful in the practice of the present invention. The vapor pressure of the liquid is preferably from about 0.01 to about 2 atmospheres at 100° C.

The degree of contact between coal and oxygen and degree of solution depends on the particle size of the coal. Any particle size up to 1000 microns is usable; however, a particle size below 5 microns would not be practical on account of the increased grinding costs. The preferred particle size is from 50 to 1000 microns with 50 to 75 microns the most preferred. Another factor influencing the contact between oxygen and coal is the amount of oxygen. The oxygen-coal weight ratio is from about 2:1 to about 25:1 and preferably from 5:1 to 15:1.

The oxidation lasts for at least about 15 minutes with about 30 minutes to about 3 hours preferred and 1 hour to 2 hours most preferred. The optimum oxidation time is determined by monitoring the oxygen absorption since the time would depend on the type of coal, particle size, amount of oxygen, and temperature. A convenient guide to stopping the oxidation step is when the absorption of oxygen has reached 6–12 grams of oxygen per 100 grams of coal. A lower quantity can be used if desired. Laboratory tests show that the process is practical down to two grams of oxygen absorption per 100 grams of coal. The maximum practical amount is about 14 grams of oxygen per 100 grams of coal. Hence any absorption from about 2 to about 14 grams can be used as an endpoint indicator. Of course, indicators besides oxygen absorption can be used.

The temperature of the oxygenation step is from about 90° C. to about 225° C. Below 90° C., the reaction proceeds slowly and above 225° C., additional reactions occur and solids are formed. Another problem associated with elevated temperatures is the possible spontaneous combustion of coal and solvent or carrier liquid. Preferably, the temperature is from about 120° C. to about 170° C. and, most preferably, it is from 135° to 150° C. If the processing equipment is enclosed, the pressure can be increased to 10 atmospheres without appreciably disturbing the oxidation. Pressures from about 5 to about 10 atmospheres produce a slightly faster reaction. The only disadvantage of a pressure in that range is the increased costs of the equipment resulting from strengthening the equipment and of a pump powerful enough to produce and maintain these pressures. Above 10 atmospheres, there is no improvement, but equipment costs increase rapidly. The preferred pressure range is from 1 to 4 atmospheres.

After the coal has been oxygenated, it is heated at a temperature from about 250° to about 450° C. It is preferred that oxygen be eliminated from the system for this step of the process. Temperatures above 450° C. are not used because they are not needed and unwanted reactions are increased. The preferred temperature is from about 350° to 450° C. and the most preferred temperature is from 400° to 435° C. The temperature is held for at least about 15 minutes, preferably from about one hour to above five hours, most preferably from two to three hours. The optimum heating time is determined by monitoring the products. The optimum end point is actually a matter of judgment depending on the temperature, the degree of oxygenation, the equipment, and the type of coal. Generally, when the rate of product formation in percent/minute has fallen below one fifth of the maximum value, the reaction is terminated.

If the processing equipment is sealed, the pressure will increase during the heating. This pressure increase comes from the vaporization of any solvent or liquid carrier and from the formation of gaseous products. The process is not hindered by the increased pressure. It is preferred that the equipment be sealed; so that, the gaseous products and liquid carrier can be recovered by e.g., distillation. Thus in the preferred embodiment of this invention, expenditures for material are slight since oxygen is obtained from air and the liquid carrier is recycled.

As in the oxidation step, catalysts may be included in the heating step. A decision to use catalysis would be based on balancing the additional cost with the benefit, e.g., increased yield or decreased processing time.

In order to better illustrate the practice of the present invention the following examples are given. It is understood that these examples are given by way of illustration and are not meant to limit the disclosure or the following claims in any manner.

EXAMPLE 1

Fifty-four grams of solvent refined coal were dissolved in 250 milliliters of quinoline and placed in a one liter reaction chamber. Air, entering the chamber through a side arm and sintered glass disc in the bottom, reacted with the coal solution at 123° C. The oxidation was carried out for 95 minutes with an air flow rate of 256 $cm^3$/min. A portion of the oxidized solution was transferred to a 6.4 mm O.D. steel tube fitted with a steel valve. The tube was cooled to −78° C., evacuated in order to remove all oxygen, and closed. The closed tube was heated at 435° C. for 290 min. Analysis of the reaction product found a 32 percent yield of material with molecular weight between 90 and 210.

EXAMPLE 2

Twenty-five grams of solvent-refined coal were dissolved in 250 milliliters of quinoline and placed in a one liter reactor. Air flowed through the 120° C. solution for 240 minutes at a rate of 250 $cm^3$/min. A portion of the oxidized solution was placed in a steel reaction tube, cooled and evacuated. After closure, the steel tube was heated at 414° C. for 300 min. The yield of products with molecular weights between 90 and 210 amounted to 22 percent.

EXAMPLE 3

Twenty-five grams of solvent refined coal were dissolved in 250 milliliters of quinoline and placed in a one liter reactor. Air was bubbled through the coal solution at 250 $cm^3$/min for 90 minutes while the temperature was held at 150° C. A portion of the oxidized solution was placed in a steel reaction tube, cooled and evacuated. After closure, the steel tube was heated at 410° C. for 180 min. Analysis of the reaction product found 10 percent yield of material with molecular weight between 90 and 210.

The examples based the yield only on those products with a molecular weight from 90 to 210. Liquid hydrocarbons with those molecular weights are the most useful. Thus the method of this invention produces the most useful liquid hydrocarbons in yields up to about 35 percent. This excellent yield is obtained with relatively mild reaction conditions, inexpensive equipment, and air as the reactant.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method for converting coal to liquid hydrocarbon or oil-soluble solids which comprises:

contacting said coal with oxygen for at least 15 minutes at a temperature from about 90° to about 225° C. to produce oxidized coal, said coal being a powder or admixed with a liquid which is nonreactive with oxygen, nitrogen, and coal and comprises an aromatic or heteroaromatic liquid hydrocarbon without any oxygen or sulfur in the ring structure;

heating said oxidized coal to a temperature from about 250° C. to about 450° C.; and maintaining said temperature for at least about 15 minutes.

2. A method of claim 1 wherein oxygen is present in a fluid comprising oxygen.

3. A method of claim 1 wherein said coal is contacted with oxygen from about ½ to about 3 hours.

4. The method of claim 1 wherein said coal is contacted with oxygen at a temperature from about 120° C. to about 170° C. until the oxygen absorption has become at least 2 grams of oxygen per 100 grams of coal.

5. The method of claim 2 wherein said coal is contacted with a fluid comprising oxygen from about ½ to about 3 hours at a temperature from about 120° C. to about 170° C.

6. The method of claim 3 wherein said coal is contacted with oxygen at a temperature from about 120° C. to about 170° C.

7. The method of claim 6 wherein said oxidized coal is heated from one to five hours at a temperature from 350° C. to 450° C.

8. The method of claim 6 wherein said coal is contacted with said fluid at a temperature from about 120° C. to about 170° C. until the absorption of oxygen has become at least about 2 grams of oxygen per 100 grams of coal.

9. The method of claim 7 wherein said fluid is air.

10. The method of claim 9 wherein said coal is contacted with oxygen at a temperature from 135° C. to 150° C. until the absorption of oxygen is at least about 2 grams per 100 grams of coal and said oxidized coal is heated to a temperature from about 350° C. to about 450° C. for one to five hours.

11. The method of claim 10 wherein said fluid is air and prior to oxidation said coal is admixed with a liquid which is nonreactive with oxygen, nitrogen, and coal and comprises an aromatic or heteroaromatic liquid hydrocarbon without any oxygen or sulfur in the ring structure.

12. The method of claim 11 wherein said liquid carrier is elected from the class consisting of quinoline, pyridine, and benzene and said fluid comprising oxygen is air.

13. The method of claim 11 wherein said liquid carrier is quinoline and oxygen is removed before said oxidized coal is heated.

14. The method of claim 11 wherein said liquid is a solvent for said coal.

15. The method of claim 13 wherein said coal is contacted with air until the absorption of oxygen has reached from 6 to 12 grams of oxygen per 100 grams of coal and said oxidized coal is heated at a temperature from 400° to 420° C.

* * * * *